United States Patent [19]

Schreiber

[11] 4,336,756

[45] Jun. 29, 1982

[54] JACKETED BULLET AND METHOD OF MANUFACTURE

[75] Inventor: Charles J. Schreiber, Grand Island, Nebr.

[73] Assignee: Hornady Manufacturing Company, Grand Island, Nebr.

[21] Appl. No.: 934,184

[22] Filed: Aug. 16, 1978

[51] Int. Cl.[3] ..... F42B 11/10

[52] U.S. Cl. ..... 102/516; 102/507

[58] Field of Search ..... 102/91, 92.1–92.7

[56] References Cited

U.S. PATENT DOCUMENTS

| | | | |
|---|---|---|---|
| 1,114,205 | 10/1914 | Watkins | 102/91 |
| 2,321,344 | 6/1943 | Whipple | 102/91 |
| 2,838,000 | 6/1958 | Schreiber | 102/92.2 |
| 3,142,256 | 7/1964 | Mack | 102/92.2 |
| 3,349,711 | 10/1967 | Darigo et al. | 102/92.2 |
| 3,426,685 | 2/1969 | Stubbs | 102/92.2 X |

FOREIGN PATENT DOCUMENTS

| | | | |
|---|---|---|---|
| 1072515 | 12/1959 | Fed. Rep. of Germany | 102/92.2 |

*Primary Examiner*—Harold J. Tudor

*Attorney, Agent, or Firm*—Vincent L. Carney

[57] ABSTRACT

The lower wall of the pre-formed jacket of a bullet is thicker than the upper portion of the jacket and the uppermost or open end of the pre-formed jacket is deformed on its interior surface to provide a plurality of flat surfaces which are joined by a plurality of axial grooves. An inwardly-extending annular ring having a downwardly sloping upper surface and an upwardly sloping undersurface is formed at a shoulder by compression between the lower, thicker wall and the thinner wall adjoining it and, where the core is pressed into the jacket, the annular ring is deformed so that its undersurface becomes perpendicular to the wall of the jacket, thus engaging and holding the base of the core within the jacket. The core and jacket are subsequently deformed into a conventional dynamic shape.

10 Claims, 14 Drawing Figures

JACKETED BULLET AND METHOD OF MANUFACTURE

This invention relates to jacketed bullets, and more particularly to jacketed bullets in which the bullet core is interlocked with the jacket.

A jacketed bullet or projectile providing the maximum degree of accuracy, shock and killing effect on a target at all ranges regardless of the velocity remaining in the bullet should have a minimum deformation of the bullet or separation of core and jacket within the core after firing and during flight, and yet be deformed readily to the maximum diameter possible upon entering the target.

To accomplish these general purposes, one class of bullets have a hardened jacket of copper or similar metal into which is inserted a malleable core, normally of lead, but of other compositions as well to provide the desired mass and yet be soft enough to deform upon striking muscular tissue and bone of the target. Although the jacket is shaped around the nose of the core to retain the core within the jacket after striking the target, in some instances, the jacket is stripped slightly from the core in the bore, or upon striking the target, the jacket is stripped completely from the core without causing deformation of the core.

To secure the core within the jacket for the maximum period of time, one prior art bullet of this class includes a jacket which is cold-worked by a punch and die to form a partition wall across the jacket near the base and the upper portion of the jacket is tapered to thin out the wall near the point of the bullet. The partitioned jacket is then filled with a rear core and a forward core, both separated from each other.

Another prior art jacketed bullet includes a jacket in which the wall adjacent to its base is thinner than the remainder of the wall of the jacket, thus forming a ledge overhanging the base portion annularly within the jacket, so that the core material placed in such jacket has a diameter at the base of the jacket greater than the diameter at the intermediate part of the jacket.

Still another prior art jacketed bullet has the base of the jacket deformed to form a central boss. This boss is ruptured to provide an annular ring on the boss extending outwardly towards the inner wall of the jacket, providing sufficient space so that the core when forced into the jacket, surrounds the deformed boss and is held by it. In this type of structure the boss need not be deformed, but instead, an annular recess may be formed in the inner wall of the jacket in the same horizontal plane as the boss.

It has also been known to deform the upper portion of the jacket which is swaged around the core, to provide within this portion of the jacket a plurality of flat segments interconnected by thinner curved segments, so that when this portion of the jacket is swaged over the core, the cold-working of the jacket under compression causes the thin curved portions to be deformed inwardly, and to obtain a thickness greater than the intermediate flat sections, and press them into the ogive portion of the core.

The previously known jacketed bullets as described above have generally been satisfactory with the velocities in use at the time of their development. However, the development of very high velocities has increased the problems with the prior art bullets, because at the instant of initial impact on a target, the mass of the core has a greater kinetic energy than before, and a greater tendency to slide forward as the jacket makes contact with the target. In such instances, it has been found that there is a tendency for the jacket to rupture by tearing back and releasing the core, or for the jacket to simply open slightly at its junction with the core, thus allowing the core to begin to slide forward. In those instances in which the core slides forward with reference to the jacket, a large percentage of the malleable core may be rubbed away during the initial penetration and before deformation, permitting the core to slip free of the jacket prior to deformation.

The jacketed bullet of the present invention is an improvement over the prior art in that: (1) the core is locked to the base portion of the jacket by mechanical construction of the jacket; (2) the jacket is constructed of a decreased thickness in the nose portion to provide for tearing easily; and (3) an increased cross-section of the jacket permits the deformation of the forward portion of the core, while retaining the core within the jacket. The method of forming the locking means in the jacket is accomplished by a less complex die and punch operation than in the prior art, and the insertion and locking of the core within the jacket is simple and certain.

The above noted and other features of the invention will be understood from the following detailed description when considered with respect to the accompanying drawings, in which.

Figure 3:
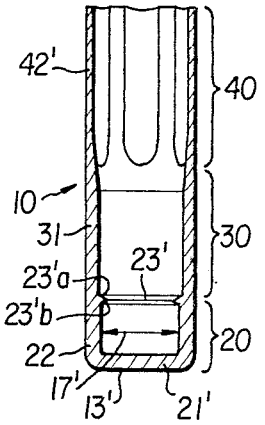
FIG. 3 is an elevational view in cross-section of the jacket of FIG. 1 after it has been prepared to receive the core.
Figure 6:
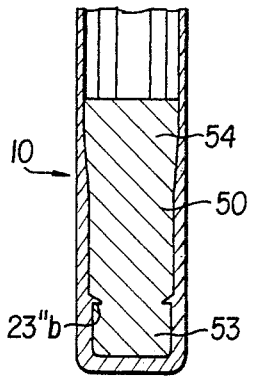
FIG. 6 is an elevational view in cross-section after the core has been inserted into the jacket.
Figure 13:
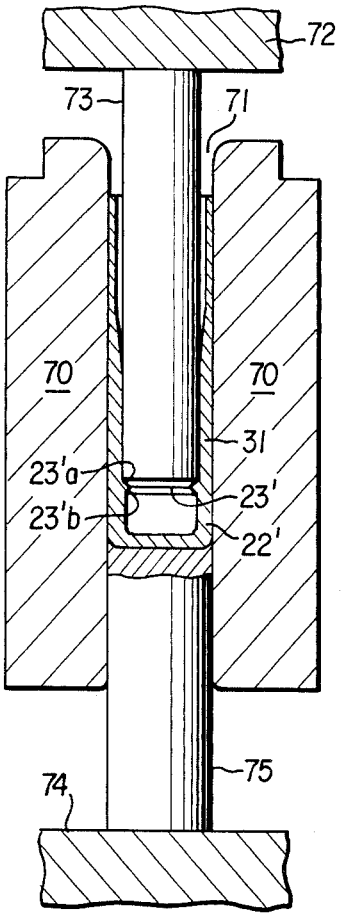
Figure 14:
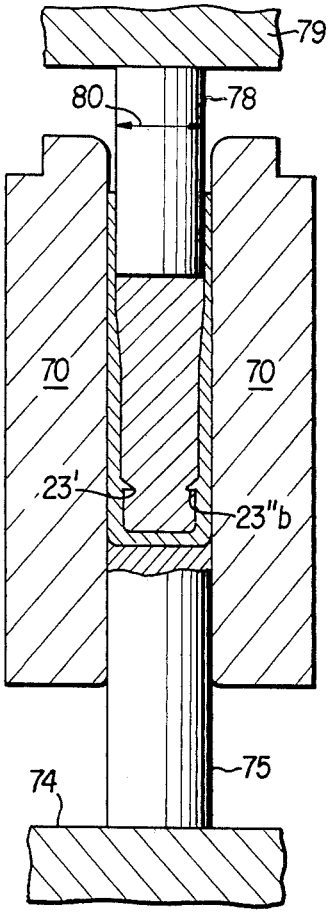

FIG. 13 is an elevation view in partial cross-section showing the second step in the method of forming the jacketed bullet of the present invention after the jacket has been deformed into the shape of FIG. 3; and FIG. 14 is an elevation view in partial cross-section showing the third step in the method of forming the jacketed bullet of the invention after the core and jacket have been combined into the construction shown in FIG. 6.

The successive forms taken by the bullet during successive stages of formation are described one at a time below with reference to FIGS. 1–9 followed by an explanation of the advantages of the bullet of this invention and the process of making it.

Figure 1:
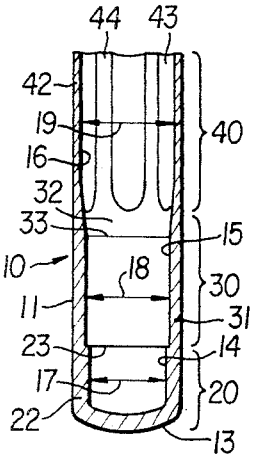
FIG. 1 is an elevational view in cross-section of a bullet in one stage of formation in accordance with the invention.

In FIG. 1, there is shown a cylindrical jacket preform 10 in one stage of preparation for receiving a core having three principal portions, a base portion 20, a mid portion 30, and an upper portion 40. The jacket has a uniform outer surface 11 but the inner surface is shaped to be thinner at the top than the bottom. The bottom portion 20 has an arcuate bottom wall 13, and an interior wall surface 14.

To provide a thinner top portion to the jacket: (1) the mid portion 30 has a cylindrical inner wall surface 15 which is of greater diameter 18 than the inner diameter 17 of lower portion 20; (2) the thickness of the wall 22 in the base portion 20 is greater than the thickness of the wall portion 31 in the mid portion 30 and is joined to it by an annular ledge 23 conjunctive with base portion 20 and mid portion 30; and (3) the upper portion 40 has an internal wall surface 16 defining a wall thickness 42 which is less than the wall thickness 31 of mid portion 30, the inner surface 16 of the upper portion 40 being joined to the inner surface 15 of mid portion 30 by an inwardly sloping surface 32 which abuts inner wall surface 15 of mid portion 30 as an abrupt annular deformation 33.

Figure 2:
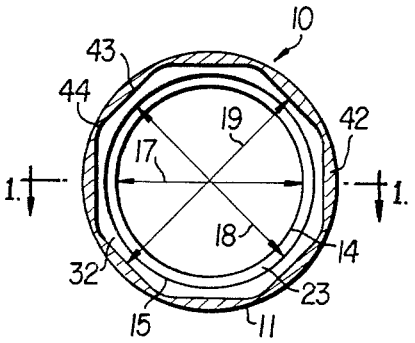
FIG. 2 is a plan view of the jacket of FIG. 1.

In the stage of formation of the jacket pre-form 10, as shown in FIGS. 1 and 2, the upper portion 40 has been deformed by a die to produce a plurality of cords 43 joined by short arcs 44 producing the wall thickness 42 in upper portion 40 for the cords 43 and the wall thickness 42′ for the arcs. The cords 42 and the joining arcs 43 may be of the type described in U.S. Pat. No. 2,838,000.

The outer surface 11 of the jacket 10 circumscribes a circle having cords 43 and arcs 44 in the upper portion 40 which provide a generally octagonal shape with a sloping surface 32 interconnecting the wall surface 16 in upper portion 40 and the wall 15 of mid portion 30. A ledge 23 interconnects the wall surface 15 of mid portion 30 and the wall surface 14 of base portion 20. As shown in FIG. 2, the wall thickness 42 is actually the thickness of the jacket between the plane surface of a cord 43 and the outer surface 11 so that the diameter 19 of upper portion 40 is greater than the diameter 18 of mid portion 30, which in turn is greater than the diameter 17 of base portion 20.

Figure 5:
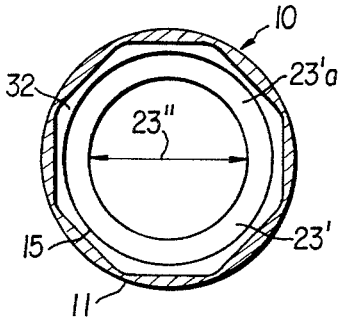
FIG. 5 is a plan view of the jacket of FIG. 3; inserted therein for forming.

In FIG. 3 there is shown the jacket 10 in another stage of preparation in which the bottom has been flattened and a marked change has taken place in the thickness of the bottom and side walls in base portion 20. As shown in this figure: (1) the wall 22 in base portion 20 has been thickened from that shown in FIG. 1; (2) the bottom wall 21′ has been thickened; (3) the wall thicknesses 42 of the upper portion 40 and the wall thicknesses 31 of the mid portion 30 have remained substantially the same as that as shown in FIG. 1; (4) the ledge 23 in FIG. 1 has now been changed into an annular, inwardly extending ring 23′ having a downwardly sloping upper surface 23′*a* and an upwardly sloping undersurface 23′*b;* (5) the diameter 17′ of the annular ring 23′ is now less than the diameter 17 of the base portion 20 shown in FIG. 1; and (6) the inner diameter 23″ of ring 23′ is less than inner diameter 17′ of the base portion. As best shown in FIG. 5, the diameters of the mid and upper portions are substantially the same as the stage shown in FIG. 2, but the diameter 23″ of the annular ring 23′ has resulted in a restriction at this juncture.

Figure 4:
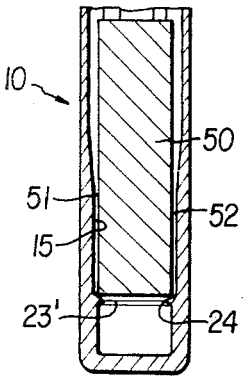
FIG. 4 is an elevational view of a cross-section of the jacket of FIG. 3 with the core partly inserted therein for forming.

In FIG. 4 there is shown the jacket 10 in the first stage of introducing the core 50 of lead, or of a similarly malleable composition, until it rests on the inner tip 24 of the annular ring 23′. In this stage an annular space 52 is formed between the outer wall of 51 of core 50, and the inner surface 15 of the mid portion 30.

In the next stage, as best shown in FIG. 6, the core 50 is completely compressed into the jacket 10. In this stage, the lower portion 53 of the core 50 completely fills the interior of the base portion 20 of the jacket 10 and in so doing deforms the undersurface 23*b* of annular ring 30 from the upward slope shown in FIG. 3 to a substantially horizontal surface 23″*b*. The core has now been changed from a cylindrical form seen in FIG. 4 to a cylindrical form filling the mid portion 30 of the jacket 10, and the upper portion of the core 50. It is a frusto-cone that completely fills the juncture of mid portion 30 and 40 up to and including the base of the cords 43 and arcs 44.

Figure 7:
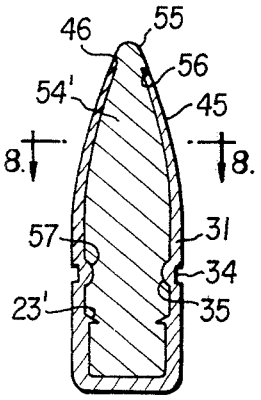
FIG. 7 is a cross-sectional view in elevation of a completed bullet made in accordance with the present invention.

In FIG. 7 there is shown a completed bullet with the upper portion 54 of the core formed into a substantially truncated cone 54′ which terminates in a rounded conical end 55. The wall of the upper portion 40 of the jacket 10 is now conical as shown at 45 and terminates in horizontal surface 46 which underlies the outer portion 56 of the conical end 55 of core 50.

To accommodate the crimped end of the cartridge casing (not shown), the outer surface of mid portion 30 (FIG. 3) contains an annular recess 34 (FIG. 7). The formation of the annular recess 34 results in the forming of a ring 35 on the inner surface of wall 31 and in the similar formation of an annular recess 57 in the lower mid portion of the core 50. This annular recess 57 bears against the correspondingly formed, inwardly extending, annular ring 35 in mid portion 30 (FIG. 3) of the jacket to provide a small measure of restraint against any relative movement between the core and the jacket.

The method and apparatus by means of which the core and jacket shown in FIG. 6 are formed into the bullet shown in FIG. 7 are not a part of the present invention and are not disclosed herein. However, the principles of such press forming may be the same as those basically disclosed in U.S. Pat. No. 2,838,000 with such modifications as may be required by the differences between the present invention as disclosed herein and the related showings in that patent.

Figure 8:
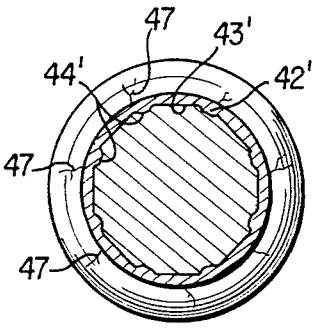
FIG. 8 is a plan in cross-section along the planes 8—8 as shown in FIG. 7.

As best shown in FIG. 8 a marked change has occured in the chords 43 and arcs 44 in the upper portion 40 of the jacket in the formation of the jacketed bullet shown in FIG. 7. During the forming of the upper portion of the jacket and core, the chords 43 retained the substantial wall thickness 42 as seen in FIG. 2 but the arcs 44′ were pushed inwardly and filled the space between adjacent chords by compression of the wall of upper portion 40 so as to reverse the relationships in that the former arcs 44 have now in effect become "lands" 44′ of a greater wall thickness 42′ than the wall thickness 42 of the cords 43 which have now become "grooves". In addition, the formation of the reversed "lands" 44′ has resulted in the formation of minute, hair-line cracks 47 on the outer surface of the conical portion 45 of the jacket opposite the "lands" 44′ as a result of the compression in forming conical portion 45 as disclosed in principle in U.S. Pat. No. 2,838,000.

As a result of this structure, when the conical end portion 55 of the core strikes the target and is compressed toward the base portion of the bullet, the compressive force exerted by the end portion 55 of the core 50 against the horizontal surface 46 and the upper portion 54' of the core produces a radial outward pressure against the inner surfaces of the reversed "grooves" 43' and "lands" 44' causing them to move outwardly. Since the thickness of the reversed "lands" 44' is greater than the thickness of the reversed "grooves" 43', rupture of the jacket tends to occur along the hair-line cracks 47 of the reversed "lands" 44'. This petal opening effect on the jacket allows the end portion 55 and mid portion 54' of the core 50 to spread radially in a mushrooming effect to increase the diameter of the bullet as it continues into the target, thus creating a greater area of contact which in turn increases the shock effect on the target.

Figure 9:
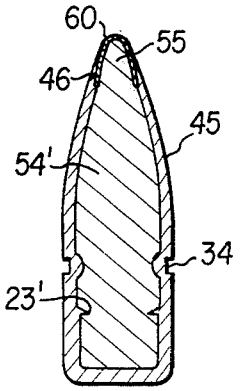
FIG. 9 is a cross-sectional view in elevation of a completed bullet made in accordance with the present invention wherein the nose of the bullet has a jacket.

In FIG. 9, there is shown a bullet having a tip jacket 60 for the conical end 55 which tip 50 extends below the horizontal surface 46 of the principal jacket for the bullet and interior thereof, thereby forming a fully jacketed bullet. In bullets of this construction, there is deeper penetration of the bullet into the target before rupture or fracture of the principal jacket begins since the tip jacket delays compression of the soft core tip 55. The tip jacket 60 increases the rate of fracture of the principal jacket because the compressive force of impact is directed more completely along the axis of the bullet as the tip jacket 60 confines the soft core tip 55 to delay its lateral expansion above surface 46 and so increased radial pressure is applied to the reversed "lands" 44' to hasten the fracture along hair-lines 47.

Figure 10:
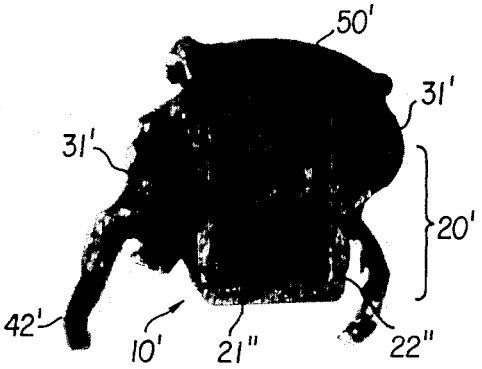
FIG. 10 is a photograph of a bullet which has not been formed in accordance with the present invention after striking a target.

In FIG. 10, there is shown a cross-sectional photograph of a bullet which was not made in accordance with the present invention, illustrating some disadvantages of the prior art, such as: (1) a jacket 10' with a very well-formed base portion 20' in which the bottom wall 21'' and the side walls 22'' were not deformed as a result of the firing of the cartridge; (2) the core 50' completely separated itself from the base portion of the jacket; (3) the walls 31'' of the jacket 10' were folded back towards the base portion of the jacket; (4) the walls 42' of the upper portion of the jacket were folded back around the mid portion and lower portion of the jacket; (5) the core 50' remaining within the jacket is substantially confined to the limits of the outer walls of the jacket 10'; and (6) the mass of the core 50' remaining in the bullet after recovery from the target is approximately two-thirds of the mass of the recovered bullet.

Figure 11:
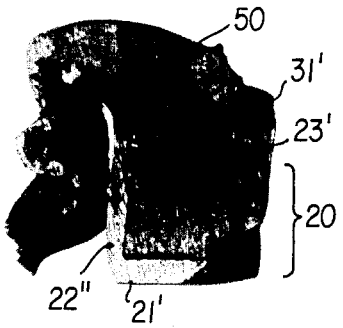
FIG. 11 is a photograph of a bullet made in accordance with the invention after striking a target.

On the other hand, in FIG. 11, a photographic reproduction of a bullet made in accordance with the present invention presents a marked contrast with the showing in FIG. 10, in that (1) the core 50 has been retained within the base portion 20 of the jacket 10; (2) the annular ring 23' maintained its formation as shown in FIG. 6; (3) a larger portion of the mass of the core 50 in FIG. 11 than the mass of the core 50' in FIG. 10 was retained within the jacket; (4) the wall 31' has not deteriorated to the extent of the prior art; and (5) the wall 31' has remained substantially within the overall diameter of the deformed bullet or projectile.

Consequently, the bullet shown in FIG. 11 has a greater shock effect on its target because of the retained mass of the core 50, even though it is deformed. Past experience indicates that the lack of mass in the core 50' is the result of the wearing away of the core in its travel through the target without having an appreciable effect upon the target itself from the standpoint of the shock action.

Figure 12:
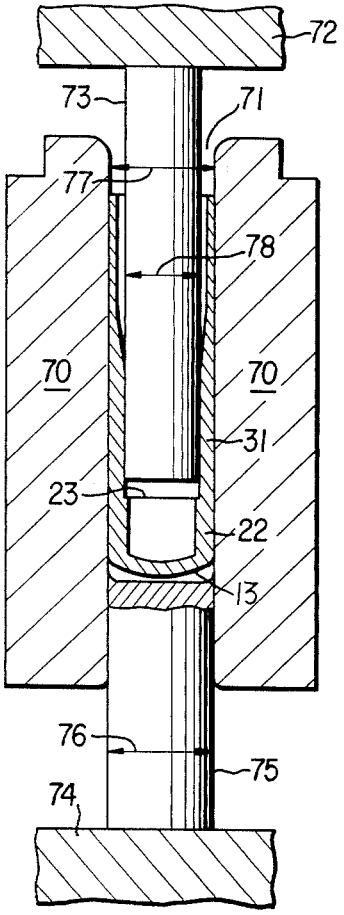
FIG. 12 is an elevation view in partial cross-section showing the first step in the method of forming the jacketed bullet in accordance with the invention when using a preform jacket as shown in FIG. 1.

In the embodiment of FIGS. 1–9, the jacket is prepared for insertion of a core in a two-step operation, shown in FIGS. 12 and 13. The formation of the jacket as shown in FIG. 3 begins with the placing of a plurality of pre-forms such as shown in FIG. 1 into a press plate 70 containing a multiplicity of bores 71 whose diameter corresponds to that of the caliber of the bullet being produced. The diameter of the bores is such that the pre-formed jacket 10 has a slidable fit therein, but its outer diameter cannot be changed during the forming operation.

Positioned above the press plate 70 is a plate 72 containing a plurality of upper punches 73 and below the press plate 70 is a plate 74 containing a plurality of lower punches 75. For purposes of illustration only, one such inter-related bore and punch is as shown in FIGS. 12 and 13. The diameter 76 of the lower punch 75 is equal to the diameter 77 of the bore 71 of the die plate 70 which is identical to the outside diameter of the pre-formed jacket 10 to preclude any deformation of the bottom of the jacket beyond its intended caliber. The diameter 78 of the upper punch 73 is equal to the diameter 18 of the interior of the mid portion 30 as seen in FIG. 1.

To form the jacket into the present invention, the upper and lower punches are moved simultaneously into contact with the jacket. The lower punch changes the arcuate bottom 13 of the preformed jacket as shown in FIG. 3. Simultaneously, the upper punch is lowered against the ledge 23 shown in FIG. 1. The resulting counter-pressures cause a flow of the metal in the preformed jacket so that the metal in the ledge 23 is pushed downward and inwardly, while at the same time the pressure of the lower punch causes a flow of the metal in the wall 22 of the lower portion 20 of the pre-form to flow upward and inwardly. The resultant of the pressures from the upper punch and lower punch and flow of metal is the production of the annular, inwardly-extending ridge 23' shown in FIG. 3 with its downwardly sloping upper surface **23'*a* and its upwardly sloping undersurface 23'*b*. The thickness of wall 22' is increased while the thickness of wall 31** remains constant.

The extent of the downward motion of the upper punch, and the upward motion of the lower punch is controlled according to the caliber of the bullet inasmuch as bullets of larger caliber, therefore having a greater mass of core, require that the annular, inwardly extending ring 23' be of lesser interior diameter for the larger caliber bullets than the lower caliber bullets in order to retain the increased mass of the core of the larger caliber bullets.

In placing the core within the jacket as shown in FIG. 14, the apparatus previously described for forming the jacket into the configuration shown in FIG. 13 is employed with the exception that the plate 70 containing the upper punches 73 for forming the jacket is replaced by a plate 79 containing an upper punch 78 whose diameter 18 is substantially equal to the diameter 17 of the upper portion 40 of the jacket shown in FIG. 3. The lower punch plate 74 remains in contact with the die plate 70 which contains the jacket as formed as shown in FIG. 3, and the upper core punch plate 79 is then lowered into contact with the core to compress it within the jacket as shown in FIG. 14.

In the insertion of the core into the jacket after its being formed into the configuration shown in FIG. 13, the undersurface 23'b of the annular, inwardly extending ring 23' assumes a substantially horizontal position. This is caused by the core, upon being pressed into the lower portion 20 of the jacket, pressing upwardly against the undersurface 23'b and deforming it before the pressure of the core as shown in FIG. 6 has been compressed into the mid portion and part of the upper portion of the casing.

The deformation of the undersurface of the annular ring 23' into a horizontal plane retains the core within the jacket by providing surface to surface contact which is perpendicular between the undersurface 23'b of the annular ring 23' and the upper surface of the core which has been compressed into the lower portion of the jacket. Thus, the retention force from the ring operating perpendicularly to the forward moving moment of the mass when the projectile strikes the target restrains the core against separation from the base portion of the jacket.

Although a preferred embodiment has been described with particularity, many modifications are possible in the light of the invention. It is therefore to be understood that within the scope of the appended claims the invention may be practiced other than as specifically described.

We claim:

1. A pre-form jacket with an open upper end and closed bottom end adapted to have a core inserted through its open end for a jacketed bullet comprising:

a cylindrical tube of material which can be cold worked;

said tube comprising an upper portion, a mid portion and a base portion;

said mid portion having a substantially cylindrical inner surface;

the interior diameter of the mid portion being less than the interior diameter of the upper portion;

a base portion having an arcuate bottom surface and a substantially cylindrical interior surface;

the interior diameter of the base portion being less than the diameter of said mid portion;

the juncture of the bottom portion and the mid portion forming an annular ledge within the jacket;

an inwardly extending ring integrally formed with the top edge of said annular ledge;

said inwardly extending ring having a downwardly and inwardly sloping upper surface and an upwardly and inwardly sloping bottom surface forming a knife edge; and the inner surface of the mid portion being joined to the inner surface of the upper portion by a frusto-conical surface.

2. A jacket for use in the maufacture of a jacketed bullet comprising:

a cylindrical tube having a closed end surface perpendicular to the side walls of the jacket;

the jacket having an upper portion, a mid portion, and a base portion;

the upper portion having an interior surface composed of a plurality of flat surfaces joined to each other by arcuate grooves, the inner diameter of the upper portion being equal to the distance between the opposing flat surfaces in said upper portion;

the mid portion having an inner cylindrical surface, which is joined to the inner surface of the upper portion by a frusto-conical surface;

the inner diameter of the mid portion being less than the inner diameter of the upper portion;

the base portion having an inner diameter less than the inner diameter of the mid portion;

the inner surface of the base portion of the jacket being joined to the inner surface of the mid portion of the jacket by an inwardly extending, annular ring having a downwardly and inwardly sloping upper surface and an inwardly and upwardly sloping undersurface; and the inner diameter of the annular ring being less than the inner diameter of the base portion, the inner diameter of the annular ring further varying inversely with the caliber of the jacket.

3. The jacket according to claim 2 wherein the thickness of the wall of the base portion is greater than the thickness of the wall of said mid portion.

4. A pre-form jacket according to claim 1 in which the thickness of the wall of the base portion is greater than the thickness of the wall of said mid portion.

5. A pre-form jacket according to claim 4 in which:

said upper portion has formed on the interior thereof a plurality of chords joined by arcs; and the interior diameter of the upper portion being measured by the diametral distance between opposing chords.

6. A bullet comprising:

an outer jacket of a cold-workable, metal composition;

an inner core of a high density malleable metallic composition;

said jacket comprising an upper portion, a mid portion and a base portion;

said mid portion having walls thicker than the walls of said upper portion and thinner than the walls of said base portion;

said base portion having a substantially cylindrical inner surface with an inner diameter less than the diameter of said mid portion forming an annular ledge between said mid portion and said base portion;

said annular ledge containing on its interior an annular, inwardly-extending ring spaced apart from the base of the bullet to engage and hold said core; and said annular ring having a downwardly and inwardly sloping first surface and an under surface extending inwardly perpendicular to the wall of said jacket, the upper surface and under surface meeting in a knife-like edge.

7. A bullet according to claim 6 in which:

said jacket has an annular cannelure formed forward of the inwardly-extending inner annular ring; and the cannelure having a spaced and parallel, annular, inwardly-extending ring on the inner surface of the jacket to engage said core.

8. A bullet according to claim 7 in which the upper portion of said jacket has a frusto-conical surface of predetermined shape which terminates short of the forward end of the composite bullet; the said core extending forward of the terminal end of said jacket.

9. The bullet according to claim 6 wherein the annular, inwardly-extending ring of said jacket has an interior diameter which varies inversely with the caliber of the bullet.

10. A bullet according to claim 6 wherein the nose portion of said core is covered with a separate jacket whose lower portion extends beyond and is contained within the upper terminous of said jacket encompassing the remainder of said core.

* * * * *

UNITED STATES PATENT AND TRADEMARK OFFICE

CERTIFICATE OF CORRECTION

PATENT NO. : 4,336,756

DATED : June 29, 1982

INVENTOR(S) : Charles J. Schreiber

It is certified that error appears in the above-identified patent and that said Letters Patent is hereby corrected as shown below:

Column 2, line 40 and 41, delete "inserted therein for forming;".

Column 2, line 61, change "preform" to --pre-form--.

Column 3, line 22, change "conjunctive" to --cojunctive--.

Column 5, line 54, change "that" to --that:--.

Column 6, line 47, change "punch," to --punch--.

IN THE CLAIMS:

Column 7, line 55, change "maufacture" to --manufacture--.

Signed and Sealed this

*Twenty-second* Day of *February 1983*

[SEAL]

*Attest:*

GERALD J. MOSSINGHOFF

*Attesting Officer*

*Commissioner of Patents and Trademarks*